US006868649B1

(12) United States Patent
Farid

(10) Patent No.: US 6,868,649 B1
(45) Date of Patent: Mar. 22, 2005

(54) ZIPPER APPLICATOR FOR PACKAGING MACHINE

(75) Inventor: Mostafa Farid, Plant City, FL (US)

(73) Assignee: Bodolay Packaging, a division of B&M, Plant City, FL (US)

( * ) Notice: Subject to any disclaimer, the term of this patent is extended or adjusted under 35 U.S.C. 154(b) by 470 days.

(21) Appl. No.: 09/706,372

(22) Filed: Nov. 3, 2000

(51) Int. Cl.[7] ..... B65B 61/18

(52) U.S. Cl. ..... 53/133.4; 53/139.2; 53/550; 53/568

(58) Field of Search ..... 53/412, 133.4, 53/139.2, 568, 550; 493/213, 214, 927; 156/66

(56) References Cited

U.S. PATENT DOCUMENTS

| | | | | |
|---|---|---|---|---|
| 3,839,128 A | * | 10/1974 | Arai | 156/66 |
| 4,430,070 A | * | 2/1984 | Ausnit | 493/927 |
| 4,709,533 A | * | 12/1987 | Ausnit | 53/451 |
| 4,945,714 A | | 8/1990 | Bodolay et al. | 53/568 |
| 5,036,643 A | | 8/1991 | Bodolay et al. | 53/128.1 |
| 5,157,811 A | | 10/1992 | Bodolay | 24/30.5 |
| 5,276,950 A | | 1/1994 | Johnson | 24/587 |
| 5,470,156 A | | 11/1995 | May | 383/210 |
| 5,529,659 A | * | 6/1996 | Ellsworth et al. | 156/66 |
| 5,783,027 A | | 7/1998 | Rodenstein et al. | 156/494 |
| 6,029,428 A | | 2/2000 | Terminella et al. | 53/551 |
| 6,047,521 A | | 4/2000 | Terminella et al. | 53/133.4 |
| 6,293,896 B1 | * | 9/2001 | Buchman | 493/213 |

FOREIGN PATENT DOCUMENTS

| | | | |
|---|---|---|---|
| EP | 0275396 | 7/1988 | 61/18 |
| EP | 0282723 | 9/1988 | 19/90 |
| EP | 0516393 | 12/1992 | 61/18 |
| JP | 4200133 | 2/1994 | 9/20 |

* cited by examiner

*Primary Examiner*—John Sipos
(74) *Attorney, Agent, or Firm*—David W. Pettis, Jr., P.A.

(57) ABSTRACT

A zipper applicator operatively attachable to and usable with a horizontal form, fill, seal and separate packaging machine of the type used to make reclosable containers from a folded web of flexible material such as, for example, plastic film. The applicator is vertically adjustable with respect to the horizontal movement of web and zipper through the machine and includes a zipper eyelet for guiding the zipper into the applicator, a web guide that engages the fold of the web material, and an applicator guide for positioning the zipper with respect to the folded web so that the zipper can be attached thereto by the application of heat and pressure from a sealer mounted on the packaging machine. The vertical adjustability permits the applicator to be used for making bags of different sizes depending upon the width of the web material being run.

1 Claim, 4 Drawing Sheets

ZIPPER APPLICATOR FOR PACKAGING MACHINE

BACKGROUND OF THE INVENTION

1. Field of the Invention

The present invention relates to a zipper applicator used in combination with a horizontal form, fill, seal and separate packaging machine. The applicator of this invention is uniquely characterized by its construction for placing the zipper into the fold of the web used to make reclosable containers to ensure accurate and secure attachment of the zipper to the web. The applicator is further characterized by its construction to provide vertical adjustability, so that bags of different sizes (height/depth) may be formed.

2. Description of the Prior Art

It is well known in the packaging industry and in the prior art to form, fill, seal and separate containers on machines generally known as either horizontal or vertical packaging machines. In recent years, it has also become quite commonplace for both vertical and horizontal machines to include structure whereby reclosable fasteners, referred to as "zippers" in the disclosure of this application, may be attached to the containers so that the containers are reclosable by the end user.

As the desirability of such reclosable packages to end users has been recognized, the packaging industry has developed numerous means for applying zippers to flexible film packages so as to provide reclosable containers. However, numerous obstacles have been encountered with regard to accurate and efficient means for placing the zipper on the package both accurately and securely. This is, of course, extremely important with regard to the packaging of food and medical items where security and reliable operability of the reclosable fastener are extremely important.

Inasmuch as the applicator of the present invention is particularly suited for use in combination with horizontal form, fill, seal and separate packaging machines, attention is invited to U.S. Pat. No. 5,036,643 as an example of one such prior art device. However, unlike the applicator of the present invention, that patent discloses and teaches attaching one half of the zipper closure to the flexible web before it is folded upon itself for making the container, and then attaching the other side of the zipper to the folded web.

An even earlier prior art device is disclosed in U.S. Pat. No. 4,945,714, and teaches that the zipper fastener halves are already attached to the web before entering the packaging machine. Obviously, then, careful registry must be maintained so that the two halves of the zipper mate properly when the web is folded upon itself to begin making the reclosable containers.

It is therefore clear that there remains a great need in the art for a zipper applicator usable in combination with a horizontal form, fill, seal and separate packaging machine so that the zipper will be placed accurately within the container for proper, substantially hermetic sealing to the bag web material. Furthermore, such an applicator should be capable of relatively simple adjustment to accommodate the manufacturer of reclosable containers of various sizes.

SUMMARY OF THE INVENTION

The present invention relates to a zipper applicator for use in combination with a horizontal form, fill, seal and separate packaging machine, that machine having a web supply and a zipper supply at one end thereof, and the machine being of the type primarily intended for use in packaging material in reclosable containers formed from a folded web and having a zipper closure. The applicator comprises a frame for attaching the applicator to the packaging machine, a zipper eyelet attached to the frame from guiding the zipper into the applicator, a web guide attached to the frame for engaging the fold of the web, an applicator guide attached to the frame for positioning the zipper and the web with respect to each other, and a sealer mounted on the machine for attaching the zipper to the web.

It is to be understood that the packaging machine to which the applicator of this invention is attached would further include means for completing the forming of the containers such as, for example, side seam sealer bars, means for placing material into the partially-formed container, means for sealing the open end of the container once it has been filled, and means for separating individual containers once the forming, filling and sealing operations have been completed. Nevertheless, it is to be understood that the scope of the present invention is not to be limited to any such particular construction for the remainder of the packing machine to which it is operatively attached. It is also to be noted that the applicator of this invention is preferably used in combination with an intermittent packaging machine as opposed to one that is continuous in its operation. The term "intermittent" is used in its normal sense to describe a packaging machine wherein movement of the web through the machine and along the various workstations pauses in accord with control devices used to operate the machine.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description of a preferred embodiment taken in connection with the accompanying drawings, in which.

Similar reference characters refer to similar parts throughout the several views of the drawings.

DETAILED DESCRIPTION

Figure 1:
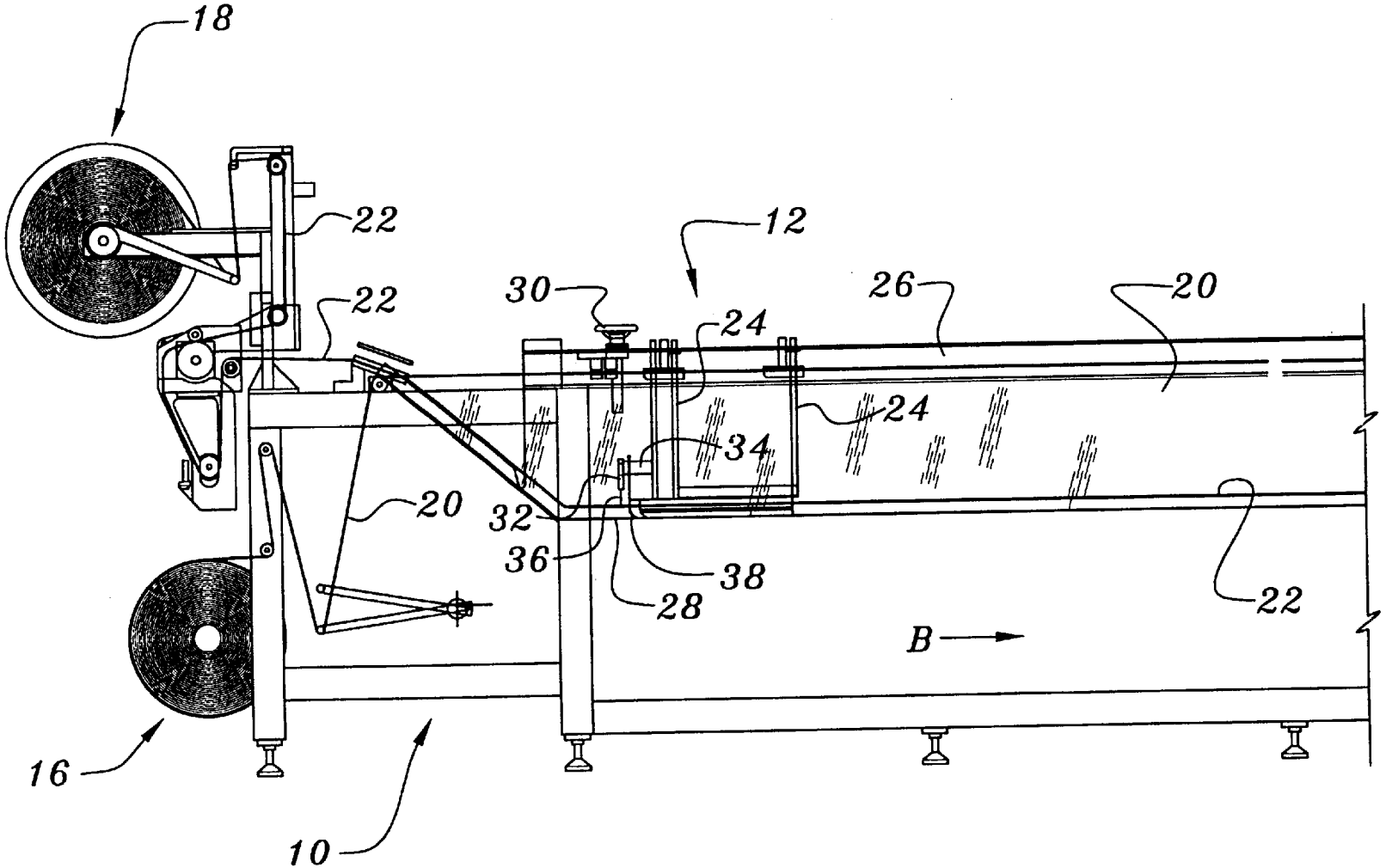
FIG. 1 is a partial side elevation of a horizontal packaging machine showing placement of the zipper applicator of this invention thereon.
Figure 2:
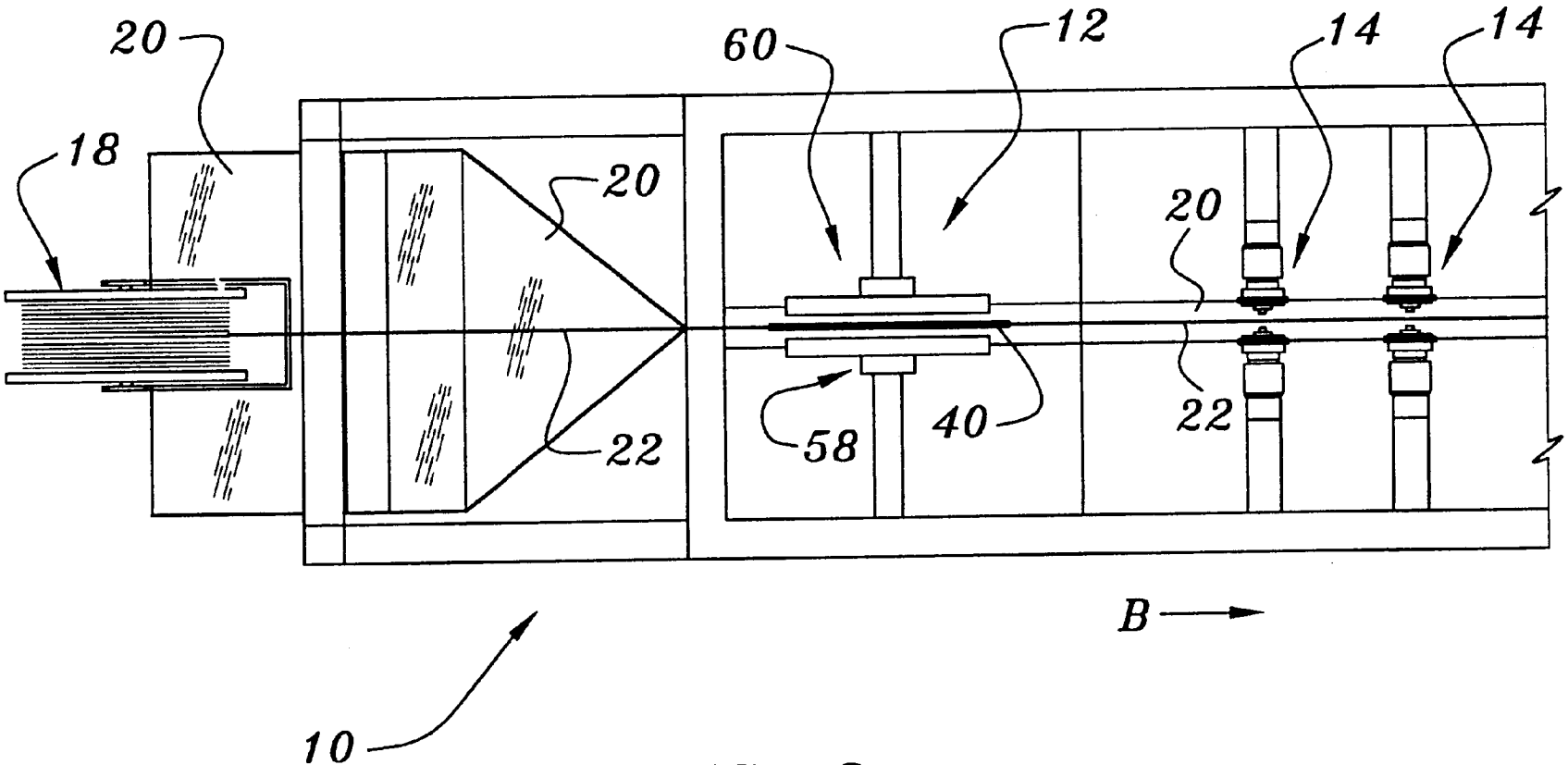
FIG. 2 is a partial top plan view of the machine shown in FIG. 1 and also showing placement of spot sealers downstream from the zipper applicator.

The views of FIGS. 1 and 2 illustrate a standard horizontal form, fill, seal and separate packaging machine, generally indicated as 10, and having the zipper applicator of this invention, generally indicated as 12, mounted thereon. The view of FIG. 2 further illustrates the provision of standard spot sealers, generally indicated as 14, downstream from zipper applicator 12.

Referring to the view of FIG. 1, it can be seen that machine 10 has a web supply roll 16 and a zipper supply roll 18 operatively attached at one end thereof. Flexible web 20 from which the final container will be made is supplied from web supply roll 16, and zipper, or zipper closure, 22 is supplied to machine 10 from zipper supply roll 18. While forming no part of the present invention, it is to be understood that packaging machine 10 includes control and drive mechanisms well known in the art for removing web 20 from its supply roll 16, folding the web upon itself, and delivering zipper 22 from its supply roll 18 inside the folded web. Web 20 preferably comprises a thermoplastic or thermoplastic-coated material for forming the containers, and zipper 22 preferably comprises a pair of mated, resealable closure strips, each one of said strips including a flange portion extending therefrom. Suitable webs 20 and zippers 22 are well known in the prior art.

Figure 5:
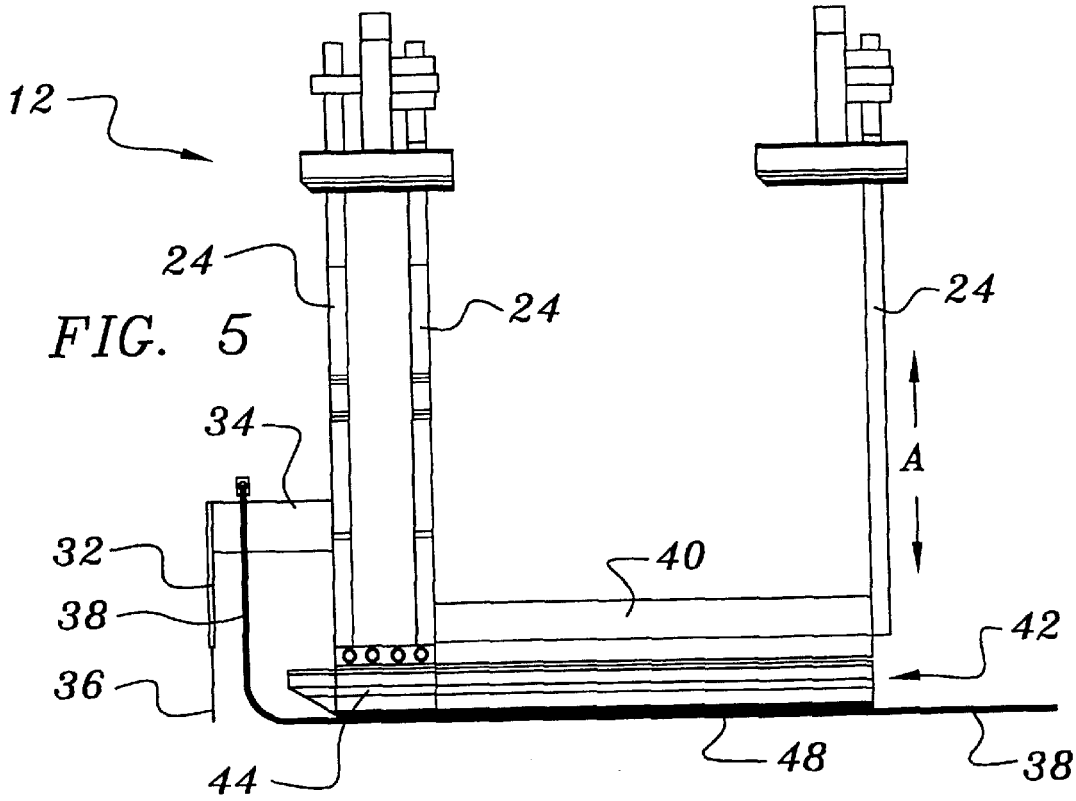
FIG. 5 is a side elevation of the zipper applicator.

Referring to the views of FIGS. 1 and 5, applicator 12 includes a plurality of vertical frame members 24 used for attaching applicator 12 as to a machine frame element 26. Applicator 22 is vertically adjustable with respect to fold 28 of web 20, and the vertical adjustment may be accomplished by any suitable means such as, for example, mechanical, electro-mechanical, pneumatic, or hydraulic devices. In the preferred embodiment of FIG. 1, vertical adjustment is accomplished mechanically by turning wheel 30. This vertical adjustment is depicted by arrow A in the view of FIG. 5. Horizontal movement of web 20 and zipper 22 through machine 10 is depicted by arrow B in the views of FIGS. 1 and 2.

Still with regard to the views of FIGS. 1 and 2, it is to be understood that packaging machine 10 would further include stations for forming side seams on the containers being made, for filling the containers, and for performing a final bottom seal and separating individual, filled reclosable containers at the end machine 10 opposite supply roll 16 and 18. Inasmuch as this structure is well known in the industry and the prior art, it is not shown in the drawing figures.

Referring now to the view of FIG. 5, applicator 12 further comprises a zipper eyelet 32 that is attached to one of the frame members 24 as by bracket 34 on the upstream side of applicator 12. As can be seen in the view of FIG. 5, zipper eyelet 32 is essentially a flat plate and includes an aperture (not shown) formed through distal and 36, zipper 22 passing through that aperture.

Applicator 12 further comprises a web guide 38 attached thereto by bracket 34. The bottom portion of web guide 38 effectively "rides" in fold 28 of web 20, thereby holding the two sides of web 20 in proper position for subsequent attachment of zipper 22 thereto.

Figure 6:
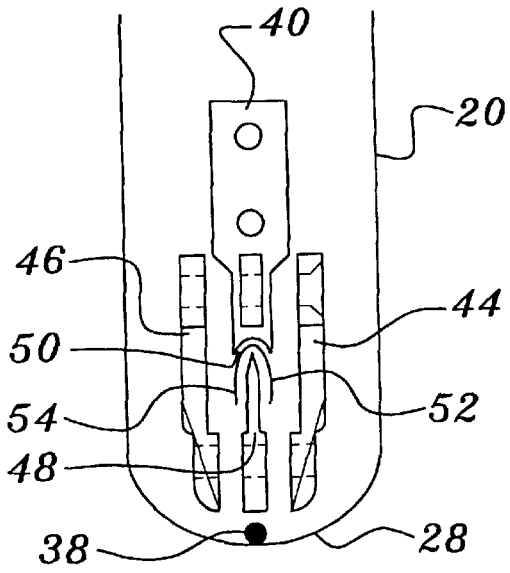
FIG. 6 is a detailed end view, with parts somewhat exploded, to show placement of the web and zipper with respect to the zipper applicator guide.

Referring now to the views of both FIGS. 5 and 6, applicator 12 further comprises an applicator guide including an upper guide member 40 and a lower guide member generally indicated as 42 in the view of FIG. 5. As shown in the exploded view of FIG. 6, lower guide member 42 includes side elements 44 and 46 and ridge element 48. When joined together by fasteners (not shown) a passageway 50 is defined between upper guide member 40 and assembled lower guide member 42. Zipper 22 passes through this passageway 50, with the joined male and female portions effectively "riding" on the top end of ridge element 48 and with the respective zipper flanges 52 and 54 depending downwardly along opposite sides of ridge element 48. Referring to the view of FIG. 5, one can see that side elements 44 and 46 terminate on the downstream side of the applicator guide, whereby zipper flanges 52 and 54 may be contacted by corresponding opposing sides of folded web 20. This construction is necessary in order to complete attachment of zipper 22 to web 20, as more fully disclosed hereinafter.

Figure 3:
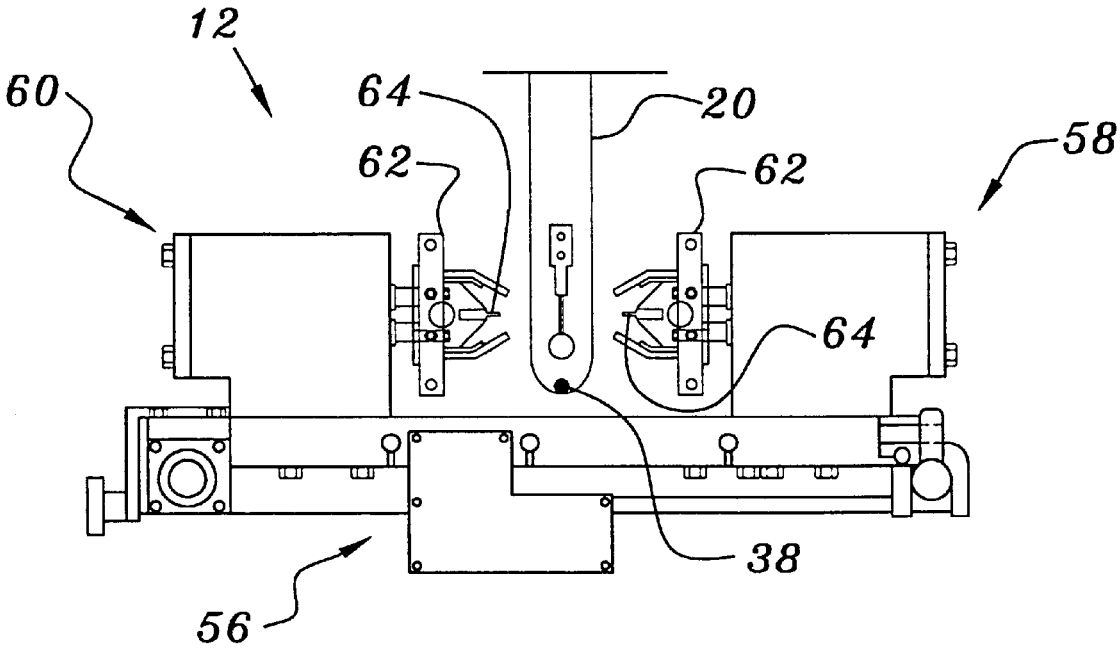
FIG. 3 is an end view of the zipper applicator.

Now, turning to the view of FIG. 3, applicator 12 further comprises a sealer, generally indicated as 56, sealer 56 being mounted on machine 10 and comprising a pair of opposed sealing heads generally indicated as 58 and 60 and both being of substantially identical construction. Jaws 62 of sealing heads 58 and 60 are movable toward and away from lower guide member 42 and the folded web 20 passing therearound. Each of the jaws 62 includes a zipper bar blade 64 which is heated and, when extended toward web 20, will cause opposing sides of folded web 20 to contact a respective one of the zipper flanges 52 and 54, sealing the web 20 to the respective flange by the application of heat and pressure through blades 64. Of course, zipper flanges 52 and 54 do not contact each other because those flanges 52 and 54 ride on opposite sides of ridge element 48. Referring to the view of FIG. 2, one can see that jaws 62 and corresponding zipper bar blades 64 are disposed longitudinally with respect to the flow through machine 10, and mounted on machine 10 downstream from side elements 44 and 46 of lower guide member 42.

Figure 4:
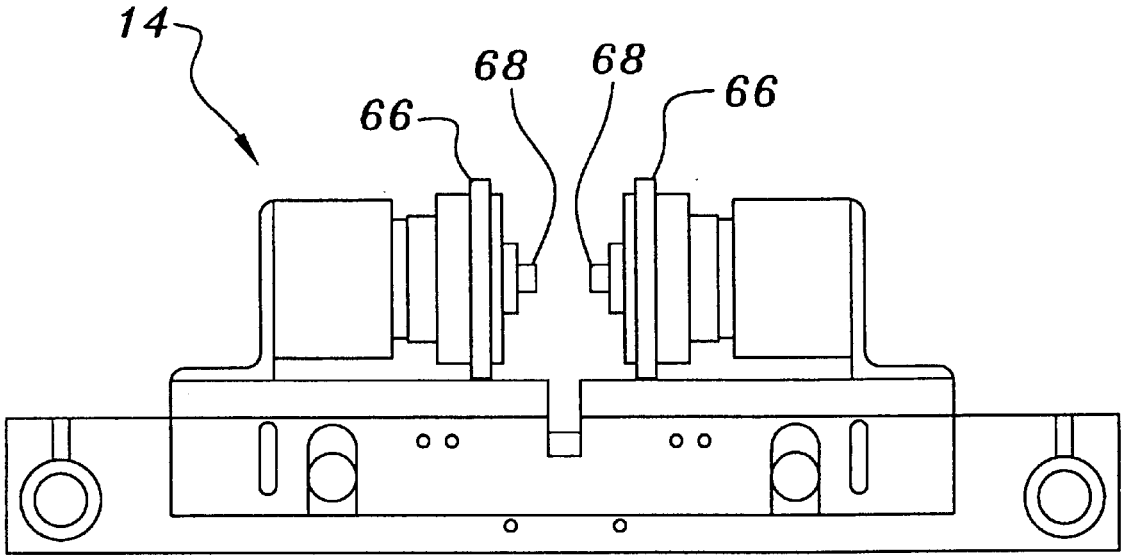
FIG. 4 is an end view of a standard spot sealer.

Referring briefly to the view of FIG. 4, spot sealers 14, which are downstream from zipper applicator 12, are defined by opposing pairs of sealer heads 66. Each of the sealer heads 66 includes a sealer tip 68 which is movable toward and away from folded web 20 having zipper 22 attached thereto. When sealer heads 66 are actuated to advance sealer tips 68 toward each other, heat and pressure transferred from sealer tips 68 to and through folded web 20 and the attached zipper 22 seals, or fuses, the male and female zipper parts together, thereby defining an end of the reclosable zipper closure. From there, the work piece continues through machine 10 to side seam forming, filling, bottom sealing, and separation stations, all of which are well known in the prior art and not shown in the drawing figures of this application.

It is therefore clear that the zipper applicator 12 of this invention provides unique, efficient means for placing a reclosable zipper 12 in relation to a folded web 20 within a standard horizontal form, fill, seal and separate packaging machine 10 in a fashion that ensures secure attachment of this zipper 22 to the web 20 and which also permits such placement and attachment for a variety of container sizes.

It will thus be seen that the object set forth above, among those made apparent from the preceding description of a preferred embodiment, are efficiently contained, and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features herein described, and all statements of the scope of the invention which, as a matter of language, might be said to fall there between.

What is claimed is:

1. A zipper applicator and sealer for use in combination with a horizontal form, fill, seal and separate machine, having a web supply and a zipper supply at one end, for use in packaging material in reclosable containers formed from a folded web and having a zipper closure, said applicator and sealer comprising:

a frame for attaching said applicator to the machine, said frame being vertically adjustable with respect to the horizontal movement of the folded web and zipper;

a zipper eyelet attached to said frame for guiding the zipper into said applicator;

a web guide attached to the frame downstream from said zipper eyelet, said web guide comprising a curved lower segment disposed in engaging relation to the fold of the web;

an applicator guide attached to the frame downstream from said web guide for positioning the zipper adjacent to the fold of the folded web, said applicator guide comprising an upper guide member and a lower guide member, said applicator guide further comprising a concave rounded zipper passageway dimensioned and configured to receive the zipper therethrough, said rounded zipper passageway being defined by a space between said upper and lower guide members, said lower guide member comprising a single ridge extending into said rounded passageway in spaced apart relation to said upper guide member, said ridge receiving the zipper thereon, and the folded web passing around said applicator guide; and a sealer mounted on the machine for attaching the zipper to the web, said sealer comprising a pair of sealing heads, each one of said pair being disposed on opposite sides of said lower guide member for reciprocal movement toward and away from the web, whereby the zipper and the web may be joined together by the application of heat and pressure when said pair move toward the web.

* * * * *